United States Patent [19]

Ericsson

[11] 4,235,501

[45] Nov. 25, 1980

[54] CONNECTOR

[75] Inventor: James W. Ericsson, Indianapolis, Ind.

[73] Assignee: Bell Telephone Laboratories, Incorporated, Murray Hill, N.J.

[21] Appl. No.: 22,120

[22] Filed: Mar. 20, 1979

[51] Int. Cl.[3] ..... H01R 13/506

[52] U.S. Cl. ..... 339/191 M; 179/1 PC; 339/154 A

[58] Field of Search ..... 179/1 PC; 339/47, 49, 339/91 R, 45 M, 126 R, 191 R, 191 M, 191 S, 22 RM, 220 R, 217 R, 217 J, 217 PS, 156 R, 159 R, 154 R, 99 R, 154 A

[56] References Cited

U.S. PATENT DOCUMENTS

| | | | |
|---|---|---|---|
| 2,955,352 | 10/1960 | Wintriss | 29/155.55 |
| 3,217,283 | 11/1965 | Shlesinger | 339/18 |
| 3,697,927 | 10/1972 | Kunkle et al. | 339/19 |
| 3,761,869 | 9/1973 | Hardesty et al. | 339/91 R |
| 3,850,497 | 11/1974 | Krumreich | 339/126 R |
| 3,970,351 | 7/1976 | Hollingsead et al. | 339/49 R |
| 4,040,699 | 8/1977 | Rasmussen | 339/91 R |

FOREIGN PATENT DOCUMENTS

| | | | |
|---|---|---|---|
| 635056 | 1/1962 | Canada | 339/45 M |

*Primary Examiner*—Richard B. Lazarus
*Assistant Examiner*—Eugene F. Desmond
*Attorney, Agent, or Firm*—Sylvia J. Chin

[57] ABSTRACT

A connector (100) in accordance with the present invention comprises a dielectric enclosure (102) having a plug receiving cavity (104) open to the front of the enclosure, and a wall (106) forming one wall of the cavity. The top wall includes an interior cavity surface (130), a front surface (124), and an exterior surface (134). On its front surface are a plurality of parallel first grooves (126) extending from associated orifices (128) to the cavity surface, and at least one second groove (132) extending from the exterior surface to the cavity surface, forming a groove end (136) open to the exterior surface (134). The second groove is for positioning a spare spring contact (242) carried by an adapter (200). Spaced flanges (140), projecting from the wall, define with the exterior surface an adapter-receiving channel (142). The channel includes latching slots (150) and guiding ribs (146) for snap-mounting the adapter. The jack also includes spring contact structures (170), each having a plurality of undulations (184) in its middle section (180) for positioning it in an assigned orifice (128).

17 Claims, 6 Drawing Figures

CONNECTOR

BACKGROUND OF THE INVENTION

1. Field of the Invention

This invention relates to the field of electrical connectors and more particularly to female type connectors which are referred to as jacks in the telephony art.

2. Description of the Prior Art

In the telephone connector art, a modular jack, such as disclosed in U.S. Pat. No. 3,850,497 (Krumreich et al), can be designed having any predetermined number of spring contact structures depending on the particular envisioned use. In some modular jack applications however, such as in a telephone handset, two electrical connections using spring contacts are usually needed though four such connections are occasionally required. Typically, in such applications, modular jacks containing four spring contact structures are then used. This is wasteful because the spare contact structures are seldom used and add to the cost of the jack.

One alternative is to leave the spare contact structures out of the jack until they are needed in the field to reduce cost of the jack. However, their installation in the field is not usually desirable because it is a delicate operation due to the small size of the contact structures and time-consuming as the contact structures must be inserted individually. Another alternative is to replace the installed jack with one having the needed number of spring contacts. This means disconnecting completely the existing connections, which is even more time-consuming.

Thus, there is need for a modular jack which can be manufactured at a reduced cost and yet allows quick and easy installation of spare spring contacts when needed.

Also, increasingly telephone handsets and other devices are being made with electronic components mass soldered onto printed circuit boards. The modular jack disclosed in Krumreich et al is designed with spring contact structures having spade-tipped insulated conductors which are secured with screws to connect with the electronics in the handset.

Desirably, a modular jack can be designed with spring contact structures which facilitate soldering onto the printed circuit board along with the other electronic components and reduce overall jack manufacturing cost at the same time.

SUMMARY OF THE INVENTION

Pursuant to the invention, a modular jack has been developed which contains only the usually needed number of spring contact structures and which is specifically configured for receiving a spare contact adapter when additional contacts are required.

In the illustrative embodiment, the modular jack comprises a dielectric enclosure having a plug receiving cavity that opens to the front of the enclosure and a top wall that forms one wall of the cavity. The top wall includes on its front surface, a plurality of parallel first grooves that extend from spaced orifice openings in the front surface to the underside of the top wall, and a plurality of parallel second grooves that extend the entire height of the front surface. The first grooves position corresponding front sections of spring contact structures in the jack. The second grooves are for positioning corresponding front sections of spare contact structures carried by the adapter when the adapter is attached.

The top surface of the top wall forms with a pair of spaced vertical flanges an adapter-receiving channel extending from the front to the rear of the jack enclosure. On the vertical flanges are ribs for guiding insertion of the adapter. The top surface of the top wall includes at least one slot for engaging a corresponding adapter surface to lock the adapter in place against forward movement of the adapter, while the front end surfaces of the ribs engage other adapter surfaces to prevent rearward movement of the adapter.

Pursuant to another aspect of this invention, the spring contact structures in the jack are each constructed of a unitary length of wire. Each such wire contact structure is formed with a rear section configured for positioning the jack with respect to a printed circuit board for soldering.

A middle section of each spring contact structure is formed with a plurality of undulations about the longitudinal axis of the middle section. Peaks made by the undulations are designed to firmly abut the interior surfaces of an associated orifice, hence to help position and securely hold the contact structure in the associated orifice.

In the illustrative embodiment, the undulation-receiving section of each orifice is elliptical in cross section. Also, the undulations of each contact structure occur in a common plane to define a transverse width larger than the diameter of the elliptical cross section along its major axis, hence ensuring an interference fit. At the same time, the configuration of the orifice prevents torsional movement of the contact structure by substantially confining it in a plane made by the major axis.

A front section of each spring contact structure is unformed and substantially collinear with the longitudinal axis of the middle section until after insertion into the associated orifice. The front section is then deformed to have a first portion which positions within a first groove associated with the associated orifice and a second portion which extends in rearward cantilever fashion in the plug receiving cavity.

The invention and its objectives, features, and advantages will be readily discerned from a reading of the description to follow of an illustrative embodiment.

DETAILED DESCRIPTION

Figure 1:
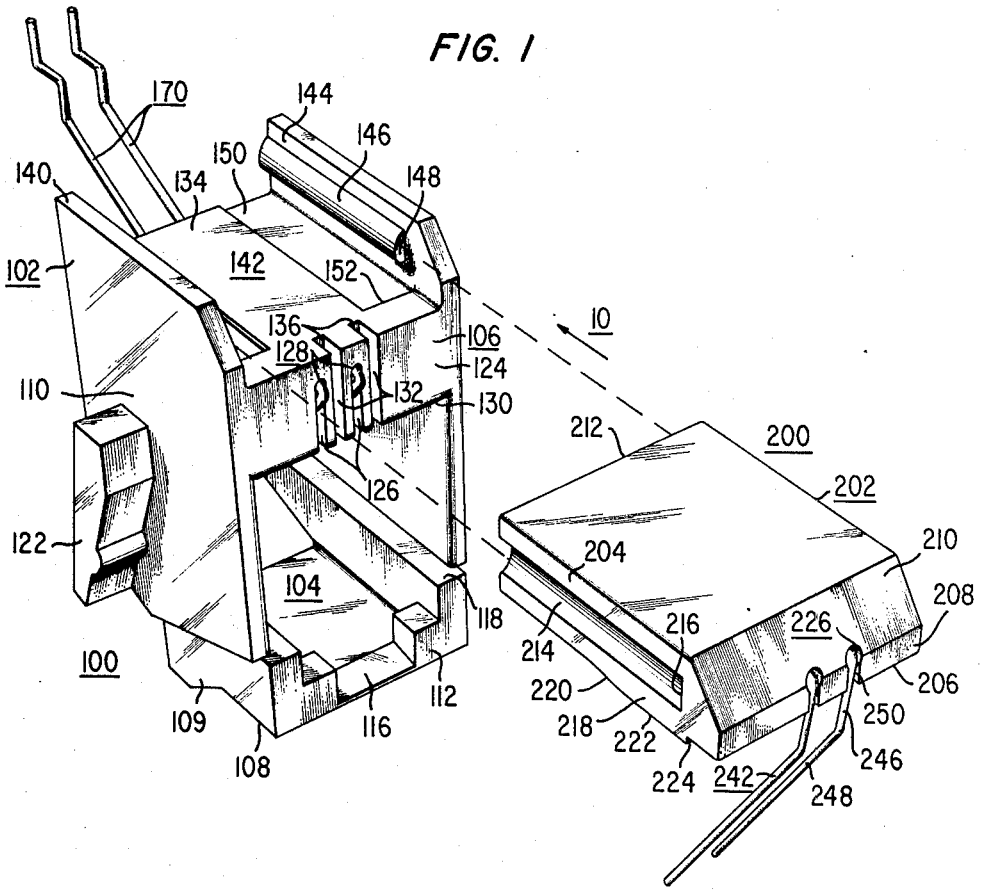
FIG. 1 is a perspective view of the modular jack and the spare contact adapter made in accordance with this invention.

Shown in FIG. 1 are illustrative embodiments 100, 200 of the modular jack and spare contact adapter respectively, made in accordance with this invention.

The modular jack 100 comprises an enclosure 102 having a plug receiving cavity 104 open to the front thereof. The enclosure 102 can be molded from a dielectric material such as acrylonitrile butadiene styrene. The cavity 104 is defined by a top wall 106, a bottom wall 108, sidewalls 110, a front wall 112 and a rear wall 114 (seen in FIGS. 2, 3, and 4).

For descriptive purposes, the walls 106, etc. have been designated as top, etc. to correspond with the orientation given to the jack 100 in the FIGURES. The orientation is arbitrary and not meant to restrict the invention. It is apparent that the top wall 106 can appear as a sidewall or a bottom wall when the jack is rotated with respect to the position shown in the FIGURES.

Figure 3:
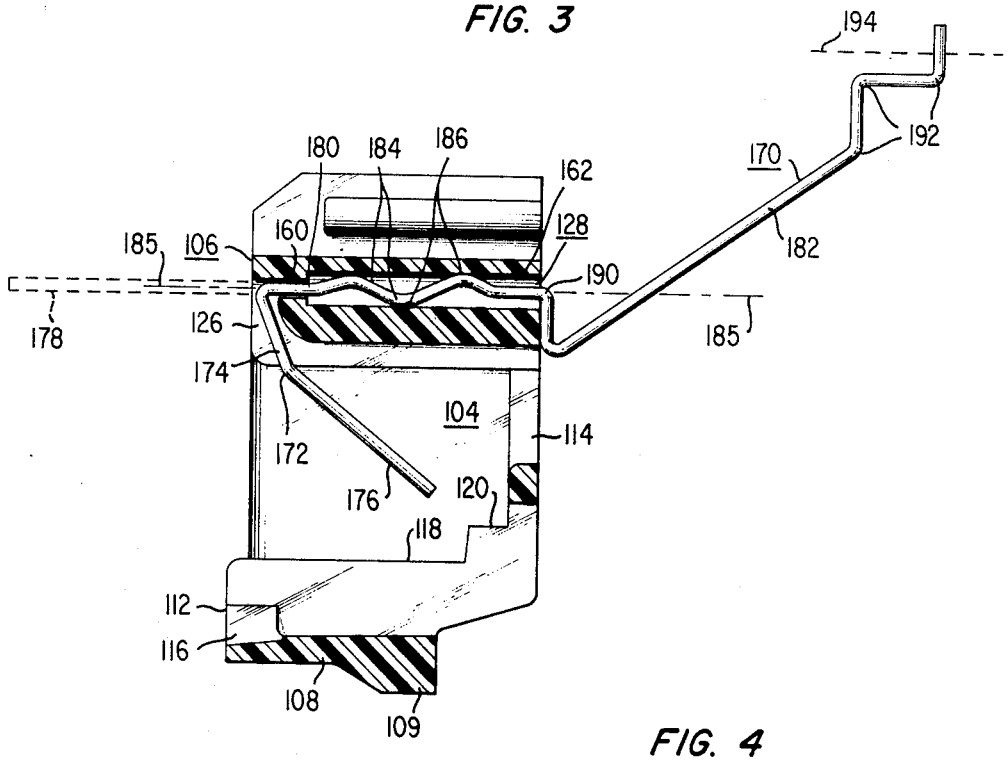
FIG. 3 is a sectional view taken along line 3—3 in FIG. 4 (with the adapter omitted) showing in detail one of the spring contact structures in the modular jack.

The front wall 112, which connects to the bottom wall 108 has a notch 116 opening to the cavity 104. Inside of each sidewall 110, a ledge 118 extends from the front wall 112 to a stop shoulder 120 (FIG. 3) to define additional cavity surfaces. The cavity side of the bottom wall 109 is stepped and tapered as seen in FIG. 3. The illustrated modular jack 100 is adapted to mate with a plug similar to that disclosed in U.S. Pat. No. 3,761,896 (Hardesty et al). However, it is apparent that the plug-receiving cavity can be designed to receive other plugs.

Referring back to FIG. 1, projecting members 122 on the exterior surfaces of the sidewalls 110 are for affixing the jack 110 to a supporting structure. Also, the sidewalls 110 indent along their lower exterior surfaces and the exterior surface of the bottom wall 108 has a downward extending protuberance 109.

An exterior front surface 124 of the top wall 106 comprises a plurality of substantially parallel first grooves 126 extending from front openings of contact-receiving orifices 128 to an interior cavity surface or underside 130 of the top wall 106. The front surface 124 also includes a plurality of substantially parallel second grooves 132 extending from the cavity surface 130 to an exterior top surface 134 to form upper groove ends 136 open to the top surface 134.

A pair of spaced vertical flanges 140, projecting from and integrally attached to the top wall 106, define with the top surface 134 an adapter-receiving channel 142 extending from the front to the rear of enclosure 102. The sidewalls of the channel 142, formed by the facing surfaces 144 of the flanges 140, include a pair of laterally guiding ribs 146 with front end surfaces 148.

In the top surface 134 of the top wall 106 are a pair of slots 150. Each slot 150 extends from the rear of the enclosure 102, stopping short of the enclosure front to form a stop with its closed front end 152.

Figure 2:
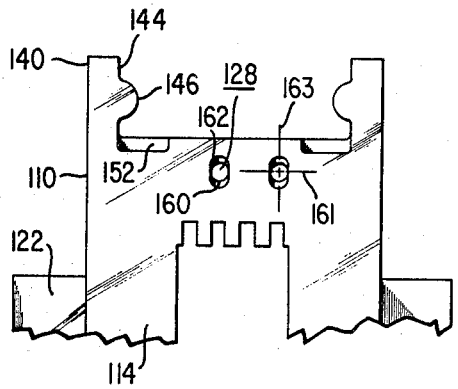
FIG. 2 depicts a partial rear elevation view of the FIG. 1 modular jack with the spring contact structures omitted.

Referring to FIGS. 2 and 3, each orifice 128, which extends from the front to the rear of the top wall 106, includes a front orifice section 160 which is circular in cross section and rear orifice section 162 which is elliptical in cross section. The diameter of the elliptical cross section along its minor axis, denoted by line 161, approximates the diameter of the front orifice section 160 as seen in FIG. 2.

Shown in FIG. 3 is a spring contact structure 170 located in an associated orifice 128. The spring contact structure 170 is constructed by forming a unitary length of wire of high tensile strength spring material such as spring temper phosphor bronze, into a front, middle, and rear section 172, 180, and 182, respectively.

The front section 172 has a first portion 174 for positioning within the associated first groove 126 and a second portion 176 for extending in rearward cantilever fashion within the plug receiving cavity 104. During jack manufacture, the front section 172 is unformed, as denoted by broken line 178, and not bent until the contact structure 170 has been inserted through the orifice 128 from the rear of the enclosure 102.

The middle section 180, which is located and supported in the orifice 128, is formed with undulations 184 about its longitudinal axis, which is denoted by line 185. The undulations 184 define a plurality of peaks 186 for abutting the interior surfaces of the rear orifice section 162, which is substantially larger cross-sectionally than the wire of the contact structure 170.

Prior to insertion into the orifice 128, the undulations 184 have a nominal peak-to-peak amplitude which is greater than the distance between the opposing interior orifice surfaces they are to abut. During insertion into the orifice 128, the surfaces of the undulations 184 facing away from the longitudinal axis 185 act as cam surfaces for insertion, while the undulations 184 resiliently deflect toward the longitudinal axis 185 as needed to fit into the orifice 128. Upon insertion, the inherent resilience in the contact structure 170 from the undulations 184 acts to ensure a tight mechanical and frictional fit as the peaks 186 bias against the interior surfaces of the rear orifice section 162.

Advantageously, in the illustrative embodiment, the undulations 184 are contained in one plane (plane of FIG. 3) to simplify manufacture. The elliptical configuration of the rear orifice section 162 helps to guide and maintain the position of the contact structure 170 by containing the undulations 184 in a plane made by the major axis, denoted by line 163 in FIG. 2, of the elliptical cross section.

Projecting from the associated orifice 128 the rear section 182 of the contact structure 170 includes a bend 190, substantially perpendicular to the longitudinal axis 185 of the middle wire section 182, to limit the extent to which the contact structure 170 can enter the orifice 128. The remaining bends 192 in the rear section 182 are designed to position the rear section 182 optimally for soldering onto a printed circuit board, the plane of which is represented by broken line 194. Advantageously, the bends in the rear section 182 are also formed in the same plane as the undulations 184 of the middle section 180 during manufacture of the contact structure 170.

Referring back to FIG. 1, the adapter 200 comprises a substantially rectangular body 202 having side surfaces 204, a bottom surface 206, a front surface 208 having a beveled top portion 210, and a rear surface 212. The body 202 is made from a dielectric material. On either side surface 204 is a lateral groove 214 which opens to the rear surface 212 and has a closed front end 216 stopping short of the front surface 208. Each groove 214 corresponds to one of the laterally guiding ribs 146 in the modular jack 100.

Projecting from the bottom surface 206 are a pair of spaced latches 218 for engaging the slots 150 in the jack 100. Each latch 218 includes a cam surface 220, a flat bottom surface 222, and a trailing blocking surface 224, shown more clearly in FIG. 6.

Figure 4:
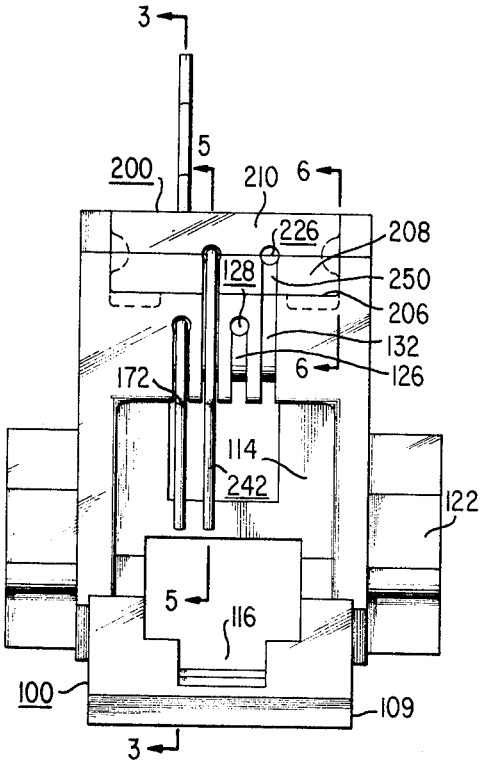
FIG. 4 depicts in front elevation the modular jack with the adapter mounted, the jack and adapter each shown as containing only one spring contact.
Figure 5:
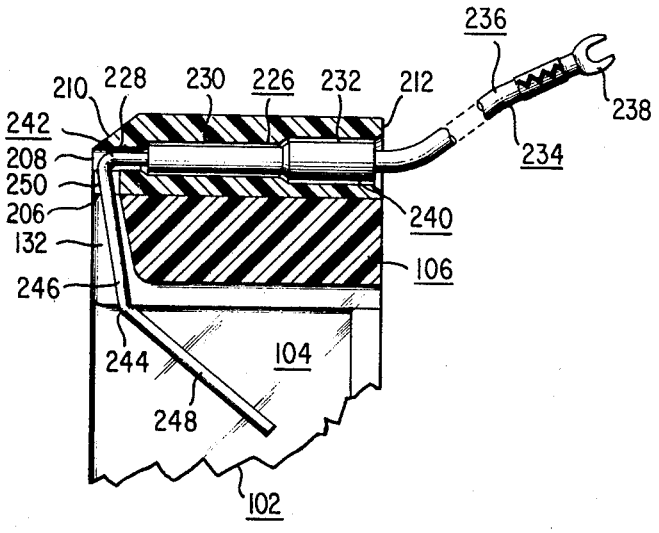
FIG. 5 is a sectional view taken along line 5—5 of the FIG. 4 assembly showing in detail the spare contact structure in the adapter.

Referring to FIGS. 4 and 5, the adapter body 202 includes at least one orifice 226 which extends from the front 208 to the rear 212. Along the front surface 208, a groove 250 extends from the associated orifice 226 to the adapter bottom 206. Each groove 250 is spaced for alignment with an associated second groove 132 in the jack 100.

As seen in FIG. 5, each orifice 226 comprises a forward section 228, a middle section 230, and a rear section 232 for accommodating a spring contact structure 234. Each contact structure 234 comprises an insulated conductor 236 having a spade tip 238 at one end and being spliced at the other end to a wire spring contact 242 with a conductive splicing member 240. The wire spring contact 242 has a front section 244 which extends from the front of the orifice 226. The front section 244 includes a first portion 246 which is positioned within the associated groove 250, and a second portion 248.

The spring contact structure 234 is similar to the spring contact structure disclosed in the aforementioned U.S. Pat. No. 3,850,497 and to the extent relevant is hereby incorporated by reference. However, it is apparent that the spring contact structures 234 and their associated orifices 226 can also be made like the contact structures 170 and orifices 128 respectively.

When the adapter 200 is snap-mounted onto the jack 100 as seen in FIG. 5, a lower part of the portion 246 of each spring contact front section 244 positions into an associated second groove 132 in the jack 100, while the second portion 248 extends in rearward cantilever fashion within the plug receiving cavity 104 of the jack 100.

From FIG. 1, the adapter 200 is shown being mounted from the front end of the jack 100 by moving it in a direction denoted by arrow 10. The adapter 200 slides easily into the adapter-receiving channel 142, which is slightly larger than the adapter 200 cross-sectionally. As the adapter 200 is further inserted, the cam surfaces 220 make contact with the top surface 134 of the jack 100 to form a tight interference fit which releases when the latches 218 are positioned into the slots 150 of the channel 142 to snap mount the adapter 200 in place.

Figure 6:
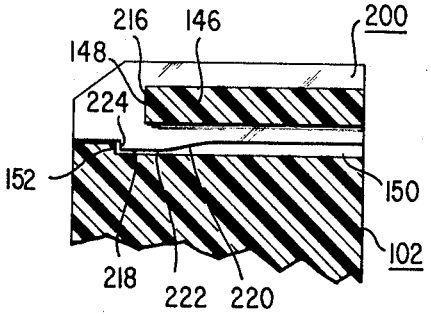
FIG. 6 depicts a sectional view taken along line 6—6 of the FIG. 4 assembly.

As depicted in FIG. 6, the latches 218 lock the adapter 200 in place against forward movement as the blocking surfaces 224 abut the closed front ends 152 of the slots 150 in the jack 100. The front closed ends 216 of the adapter grooves 214 also substantially abut the corresponding front end surfaces 148 of the guiding ribs 146 to prevent rearward movement of the adapter 200.

While the invention has been described with reference to an illustrative embodiment, it is to be understood that various modifications thereto might be made without departing from the spirit and scope of the following claims.

I claim:

1. A connector (100) comprising:

a dielectric enclosure (102) having a plug receiving cavity (104) open to the front of the enclosure with a wall (106) forming one wall of the cavity, the wall having a cavity surface (130), a front surface (124), and an exterior surface (134), the wall including a plurality of spaced orifices (128) that extend from its front surface toward its rear and a plurality of substantially parallel first grooves (126) on its front surface, each first groove extending from the front end of an associated individual orifice (128) to the cavity surface (130); and a plurality of first spring contact structures (170), each first contact structure being accommodated in an associated orifice and having a front spring contact section (172) with a first portion (174) positioned within an associated groove and a second portion (176) extending in cantilever fashion within the plug receiving cavity; characterized in that:

the front surface comprises at least one second groove (132), where the second groove extends from the exterior surface to the cavity surface; and means for mounting (142) an adapter (200) having one or more spare second spring contact structures (234), each second contact structure having a front section (244) with a first portion (246) and second portion (248) such that at least some part of each first portion positions within an associated second groove and the second portion extends in cantilever fashion within the plug receiving cavity when the adapter is mounted.

2. The connector (100) pursuant to claim 1 where the mounting means (142) comprises:

an adapter-receiving channel (142) substantially adjacent the exterior surface (134) of the wall (106); and means for locking (146, 150) the adapter in place in the channel.

3. The connector (100) pursuant to claim 2 where the mounting means (142) further comprises:

means for guiding (146) the insertion of the adapter (200).

4. The connector (100) pursuant to claim 3 where the channel (142) extends substantially from the front of the enclosure (102) to its rear; and where the guiding means (146) further comprises a pair of lateral ribs (146), each projecting from one of a pair of facing surfaces (144) defining sidewalls for the channel.

5. The connector (100) pursuant to claim 2 where the locking means (146, 150) comprises:

at least one slot (150) in one of the surfaces (134) defining the channel (142), the slot terminating short of the front surface (124) of the wall (106) to define a surface (152) for blocking forward movement of the adapter (200); and means for blocking (148) rearward movement of the adapter.

6. In combination with the connector (100) pursuant to claim 1, an adapter (200) comprising:

a dielectric body (202) having a front surface (208), and a rear surface (212), the body including at least one orifice (226) extending from the front to the rear surface; and a spare second spring contact structure (243) accommodated in the orifice (226), the second spring contact structure having a front spring contact section (244) with a first portion (246) and a second portion (248), where the first portion (246) positions substantially in an associated groove (132) and the second portion (248) extends in cantilever fashion within the plug receiving cavity (104) when the adapter is mounted,

7. The connector (100) pursuant to claim 1 where at least one first spring contact structure (170) is constructed from a unitary length of wire.

8. The connector (100) pursuant to claim 6 where the first spring contact structure (170) includes a plurality of undulations (184) to help position the contact structure in its associated orifice (128).

9. The connector (100) pursuant to claim 8 where the undulations (184) are formed in a common plane; and where the associated orifice (128) has at least one section (162) having a non-circular cross section with a major axis (163) in the cross section for substantially confining the undulations in a plane made by the major axis.

10. The connector (100) pursuant to claim 9 where the section (162) is elliptical in cross section.

11. The connector (100) pursuant to claim 8 where a middle section (180) of the first contact structure (170) contains the undulations (184) and a rear section (182) of the first contact structure (170) extends from the rear of the orifice (128).

12. A connector (100) comprising:

a dielectric enclosure (102) having a plug receiving cavity (104) open to the front of the enclosure with a wall (106) forming one wall of the cavity, the wall having a cavity surface (130), a front surface (124), and an exterior surface (134), the wall including a plurality of spaced orifices (128) that extend from its front surface toward its rear and a plurality of substantially parallel first grooves (126) on its front surface, each first groove extending from the front end of an associated individual orifice (128) to the cavity surface (130); and a plurality of first spring contact structures (170), each first contact structure being accommodated in an associated orifice and having a front spring contact section (172) with a first portion (174) positioned within an associated groove and a second portion (176) extending in cantilever fashion within the plug receiving cavity; characterized in that:

at least one first spring contact structure is a unitary length of wire which includes a plurality of undulations (184) for positioning the contact structure in an associated orifice;

the front surface (124) of the wall (106) comprises at least one second groove (132), where the second groove extends from the exterior surface (134) to the cavity surface (130); and the connector also includes means for mounting (142) an adapter (200) having one or more spare second spring contact structures (234), each spare contact structure having a front section (244) with a first portion (246) and second portion (248) such that each first portion positions substantially within an associated second groove and the second portion extends in cantilever fashion within the plug receiving cavity when the adapter (200) is mounted.

13. The connector (100) pursuant to claim 12 where the mounting means (142) comprises:

an adapter-receiving channel (142) substantially adjacent the exterior surface (134) of the wall (106); and means for locking (146, 150) the adapter (200) in place of the channel.

14. The connector (100) pursuant to claim 13 where the locking means (146, 150) comprises:

at least one slot (150) in one of the surfaces (134) defining the channel (142), the slot terminating short of the front surface (124) of the wall (106) to define a surface (152) for blocking forward movement of the adapter (200); and means for blocking (148) rearward movement of the adapter.

15. The connector (100) pursunt to claim 13 where the mounting means (142) further comprises:

means for guiding (146) the insertion of the adapter (200).

16. The connector (100) pursuant to claim 15 where the channel (142) extends substantially from the front of the enclosure (102) to its rear; and where the guiding means (146) further comprises a pair of lateral ribs (146), each projecting from one of a pair of facing surfaces (144) defining sidewalls for the channel (142).

17. A connector (100) comprising:

a dielectric enclosure (102) having a plug receiving cavity (104) open to the front of the enclosure with a wall (106) forming one wall of the cavity, the wall having an exterior surface (134), a front (124) surface, and a cavity surface (130), with the front surface of the wall comprising a plurality of substantially parallel grooves (132) where the grooves extend from the exterior surface to the cavity surface, forming groove ends (136) open to the exterior surface (134), the enclosure also including means for mounting (142) an adapter (200); and the adapter comprising:

a dielectric body (202) having a front surface (208), and a rear surface (212), the body including a plurality of orifices (226) extending from the front to the rear surface; and a plurality of spring contact structures (234), each accommodated in an orifice (226), each spring contact structure having a front spring contact section (244) with a first portion (246) and a second portion (248), where the first portion (246) positions substantially in an associated groove (132) and the second portion (248) extends in cantilever fashion within the plug receiving cavity (104) when the adapter is mounted.

* * * * *

UNITED STATES PATENT AND TRADEMARK OFFICE

CERTIFICATE OF CORRECTION

PATENT NO. : 4,235,501

DATED : November 25, 1980

INVENTOR(S) : James W. Ericsson

It is certified that error appears in the above—identified patent and that said Letters Patent is hereby corrected as shown below:

In the Drawings, Sheet 1, FIG. 1, add reference numeral --234-- to the spring contact structure; Sheet 2, FIG. 4, delete horizontal line in orifice 226, delete horizontal line at the orifice of wire spring contact 242. In the Abstract, line 1, "(100) in" should read --(100) made in--; line 5, "top wall" should read --wall--; line 11, "surface," should read --surface and--; line 13, "contact (242)" should read --contact structure (234)--; line 17, "snap-mounting" should read --engaging--. Column 1, line 16, "connections using spring contacts are" should read --connections are--. Column 2, line 63, "contact;" should read --contact structure;--. Column 3, line 5, "respectively, made" should read --respectively, which are made--; line 22, "Inside" should read --Along the inside--; line 28, "3,761,896" should read --3,761,869--; line 33, "110" should read --100--. Column 6, line 8, "means" should read --the connector also includes means--; line 45, "(208)," should read --(208)--; line 49, "(243)" should read --(234)--. Column 8, line 2, "of" should read --in--.

Signed and Sealed this

*Fourteenth* Day of *September 1982*

[SEAL]

*Attest:*

*Attesting Officer*

GERALD J. MOSSINGHOFF

*Commissioner of Patents and Trademarks*